United States Patent [19]

Rayfield et al.

[11] Patent Number: 4,500,085

[45] Date of Patent: Feb. 19, 1985

[54] OSCILLATING WHEEL PAPER ITEM STACKING APPARATUS

[75] Inventors: Wilson P. Rayfield, Longwood; Emmett B. Peter, III, Orlando; Richard E. Shultz, Maitland, all of Fla.

[73] Assignee: Burroughs Corporation, Detroit, Mich.

[21] Appl. No.: 485,092

[22] Filed: Apr. 14, 1983

[51] Int. Cl.[3] ..... B65H 31/00

[52] U.S. Cl. ..... 271/207; 271/236

[58] Field of Search ..... 271/236, 238, 207, 220, 271/278

[56] References Cited

U.S. PATENT DOCUMENTS 2,910,293 10/1959 Kelchner ..... 271/236

4,257,587 3/1981 Smith ..... 271/236

*Primary Examiner*—Richard A. Schacher

*Attorney, Agent, or Firm*—Carl Fissell, Jr.; Kevin R. Peterson

[57] ABSTRACT

Sheet item stacking apparatus wherein an eccentric drive oscillating articulated arm carries a friction wheel at one end, and wherein an angularly disposed cross link pivoted at one end to the arm and at the opposite end to a fixed support causes the oscillating arm to move both forwardly and rearwardly as well as from side to side effective to edge align incoming sheet items within an operably associated item hopper from which the items are "front" removable.

10 Claims, 7 Drawing Figures

OSCILLATING WHEEL PAPER ITEM STACKING APPARATUS

BACKGROUND OF THE INVENTION

1. Field of the Invention

The invention relates broadly to sheet item paper stacking apparatus and more particularly to sheet item paper stacking apparatus having means for moving individual sheet items both forwardly into a stacking hopper as well as at right angle thereto so as to edge align the items against the inner walls of the item hopper.

2. Description of the Prior Art

A basic problem with sheet item stacking apparatus in the past has been the difficulty in obtaining a neatly edge aligned stack of items within an item receiving hopper or bin.

Paper items, such as the type utilized for copying/-printing purposes tend to be fairly flimsy, easily bent, deformed, crumpled and creased in use. They are effected by the aero dynamics of the passage of the paper through the air as the paper leaves the handling operation into the stacking area. More particularly, employed, as in electro-graphic printer/copying apparatus, the electrostatic charge deposited on the paper, even though almost totally eliminated during processing, makes paper stacking quite difficult due to the sheets adhering to one another.

Prior art stacking devices include vibrating floors within the stacking tray or bin, helical, wide threaded screw members disposed at right angles to the item flow, rotating wheels, pusher arms, etc. those which are reasonably effective are also relatively expensive and-/or complex to build and maintain.

In smaller, highly efficient printer/copier devices the prior art adaptations are not cost effective. Thus, in smaller devices the copies simply outflow into a bin or tray and leave it to the operator to neatly stack the items as desired subsequent to removal from the hopper-bin.

SUMMARY OF THE INVENTION

The present invention solves these and other associated stacking problems in a new, novel and heretofore unobvious manner by providing an oscillating arm including pivoted means permitting the end of the arm to partake of orthogonal movements relative to the pivot point causing a one-way rotatable friction mechanism at the end of the arm to drive the items said thereto into and against the rear end and side walls of a hopper.

In accordance with the present invention one end of an elongated, light weight, rod like member is rotatable by means of an eccentric about an input drive shaft. The opposite, substantially spade shaped, end of the rod like member carries a rotatable, friction wheel disposed on the arm at a substantial angle to the long dimension thereof and provided with a one-way bearing. A slotted link fixedly pivoted at one end to the end of the machine frame has its opposite free end slotted so as to slidably engage through a slot in the arm with the end of the rod like member. Means is provided intermediate the ends of said rod like member permitting the free end thereof to oscillate horizontally causing the wheel at the far end thereof to engage and move the items fed into the hopper along its long dimension while concurrently moving the items normal to the long dimension thereof automatically edge aligning the items within the hopper.

BRIEF DESCRITION OF THE DRAWINGS

BRIEF DESCRIPTION OF AN EMBODIMENT OF THE INVENTION

Figure 1:
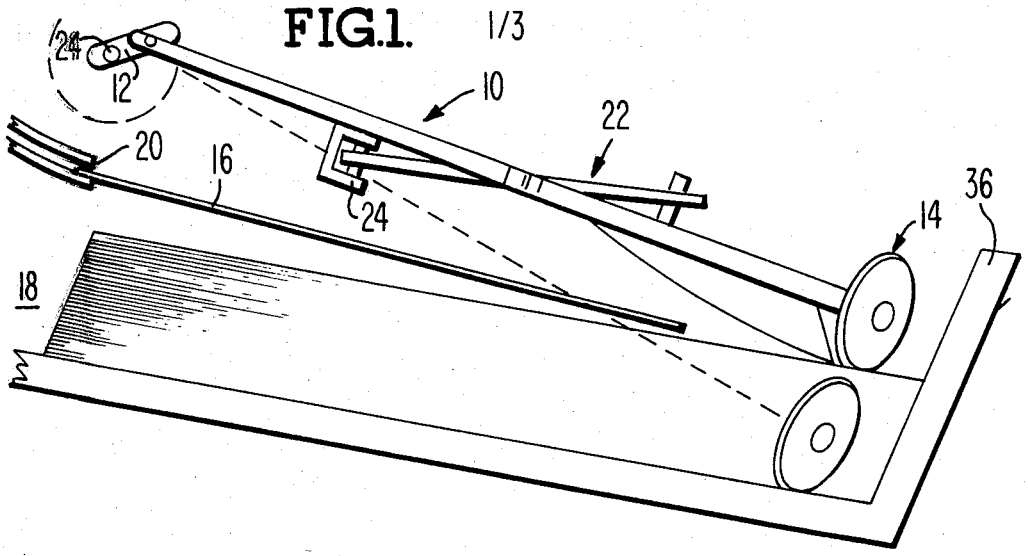
FIG. 1 is a highly schematic illustration of an item hopper/bin with the item aligner in an operating environment.

As seen in the highly schematic illustrations of FIGS. 1–4 inclusive, the apparatus embodying the present invention in its broadest aspects, comprises an articulated, elongated arm or linkage 10, one end of which is rotatably pivoted to an eccentric drive member 12 and the opposite free end of which carries a one-way rotatable friction member 14 engageable with incoming sheet items 16 being fed into a receiving hopper or receptacle 18 from an in feed chute 20 of a printer/-copier.

A cross link 22, angularly disposed relative to the linkage 10 is loosely, fixedly pivoted at one end 24 while the opposite end of cross link 22 is pivotally connected to the forward end of linkage 10 by means of an elongated slot 26 and pin 28 as will be described more clearly hereinafter.

In one embodiment of the present invention articulation of the linkage 10 is provided by means of a necked down area forming a flexure 30 while in another embodiment of the linkage 10 the articulation is provided by means of a pivot hinge 32, as will be described in detail later on herein.

As seen most clearly in FIG. 1, the linkage 10 is arranged so as to extend angularly, downwardly away from the eccentric drive 12 and toward the inward bottom portion of the hopper 18. The linkage 10 (which is loosely pivoted to eccentric 12) is by this means enabled to move from the dotted line position in FIG. 1 to the full line position i.e. from the empty hopper position to the full hopper position.

Since it is desirable for the friction member 14 to not apply friction to the sheet item during the item input condition of the stacking operation, a one way clutch 34 is provided for member 14 for purposes to be described shortly.

OPERATION

In order to provide complete edge alignment of sheet items, it is required that two forces acting substantially at right angles to each other be applied to the incoming sheet items 16. With respect to the schematic illustrations of FIGS. 1, 2, 3 and 4 inclusive, this means a force to drive the item into contact with the end wall 36 of the hopper 20 and a concurrent force normal thereto to drive the item against the inner side wall 38 of hopper 20.

Since a single elongated rigid member cannot partake of two forces acting at right angles without distortion or possible fracture, member 10 is provided with flexure means 30 enabling the free end thereof to move slightly, angularly with respect to its longer axis. By notching opposite sides of a portion of member 10 a weakened, bendable portion is produced. This undercut portion or flexure permits member 10 to bend slightly along its length at this point. The cross arm or link 22 pivoted at one end to the frame of the apparatus and coupled at its opposite end to member 10 by means of slot 26 and pin 28 effectively translates the oscillatory movement of member 10 into right angled movement as eccentric 12 is rotated by the drive means.

The present mechanism, in accordance with the teachings of the invention, utilizes the eccentric to cause one end of the member 10 to move in a circular motion while the cross link 22 causes the articulated portion of member 10 to pivot once member 10 reaches a certain position in its forward stroke. This action in turn causes the friction member 14 at the free end of the arm 10 to move in a triangular path designated 1, 2 and 3 of FIGS. 2, 3 and 4, as will now be described with reference to FIGS. 2–4 inclusive.

Figure 2:
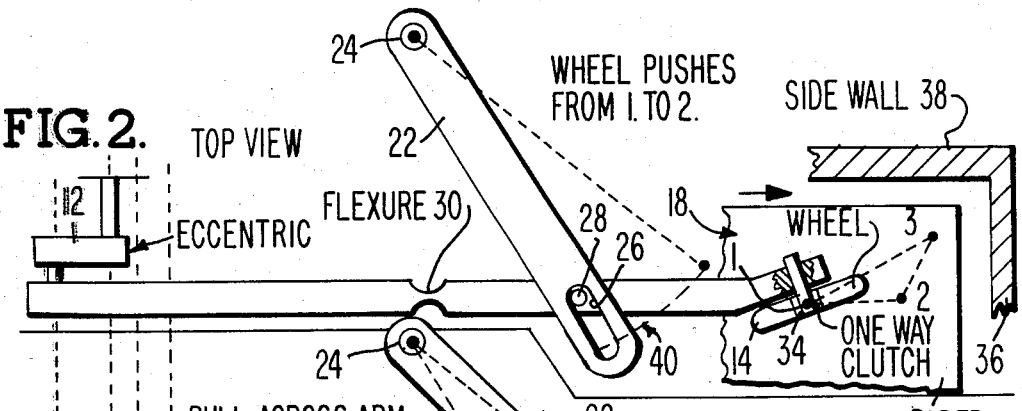
FIGS. 2, 3 and 4 are highly schematic illustrations of the various operating positions of the item aligner in accordance with the present invention.

In FIG. 2, the eccentric 12 has positioned member 10 all the way to the left with the friction member 14 in position (1). The flexure 30 is unflexed so that the member 10 is axially straight.

Figure 3:
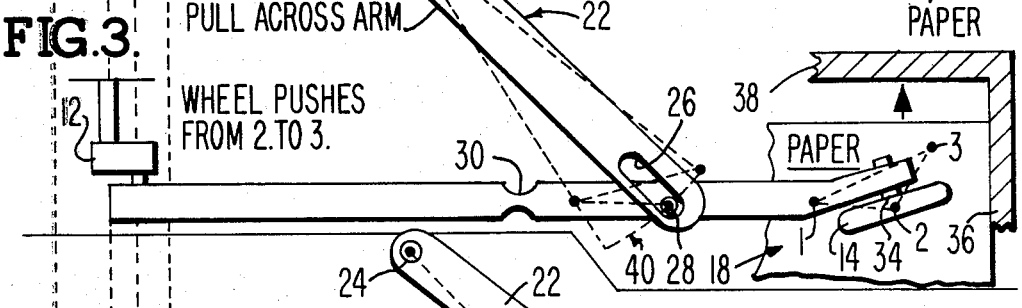

Continued rotation of eccentric 12 causes the member 10 to move in a straight line, FIG. 3, rightwardly from position (1) to position (2). This straight line motion pushes the incoming paper items 16 against the end wall 36 of hopper 18. One way clutch 34 prevents rotation of member 14 in a clockwise (CW) direction as seen in FIGS. 2 and 3 so the member 14 drives the sheet item forwardly (or skids across the already stacked sheet). In the reverse direction the clutch permits the wheel to roll over the sheet items.

The motion from position (2) to (3) is accomplished by means of the cross link 22 in position (2) the pin 28 has reached the end of the slot 26 in link 22. A this point the link is constrained to move along a path tangent to a circle or around the center of the link. The link is now pivoting at one end (fixed to the machine frame) and from positions 1–2 the pin is simply moving within the slot. At position (2) the pin can no longer move in a straight line forward since the link 22 constrains it. Now the pin is forced to the side (toward the rear side wall) causing the pin to move in an arc 42 which is turn. moves the arm sideways at a shallow angle (approximately 10 degrees) toward the (rear) side wall. This moves the paper to this rear side wall.

Figure 4:
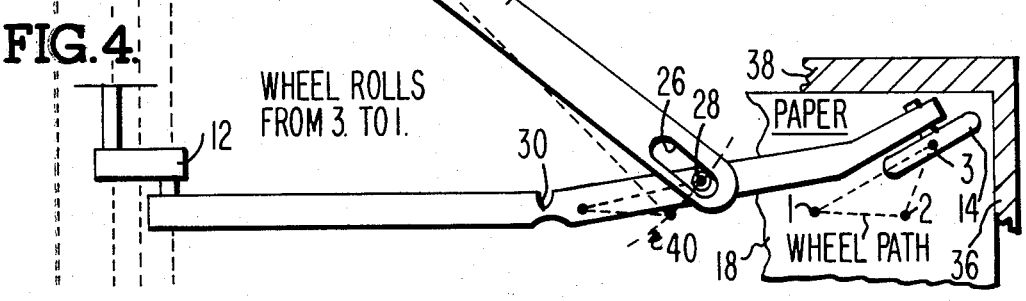

In FIG. 4 the eccentric 12 has driven the arm or linkage 10 to the full extent of its forward travel and the eccentric now starts to pull the linkage 10 backwards. The friction member 14 is in line with the line of motion which the arm is going to follow in moving from position (3) back to position (1). The one way clutch 34 now permits the rotative member 14 to roll over the sheet items 16 as the arm 10 (which is flexed by the cross link creating the sidewise motion) moves back to position (1).

STRUCTURAL EMBODIMENT

Figure 5:
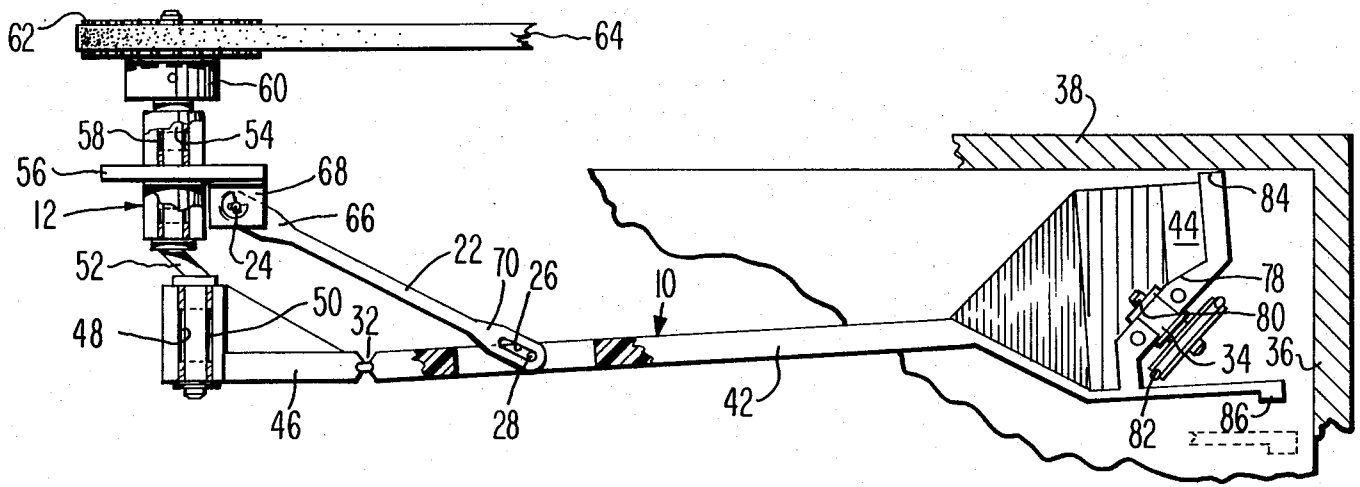
FIG. 5 is a top plan view of a modified version of the stacker of FIG. 4.
Figure 6:
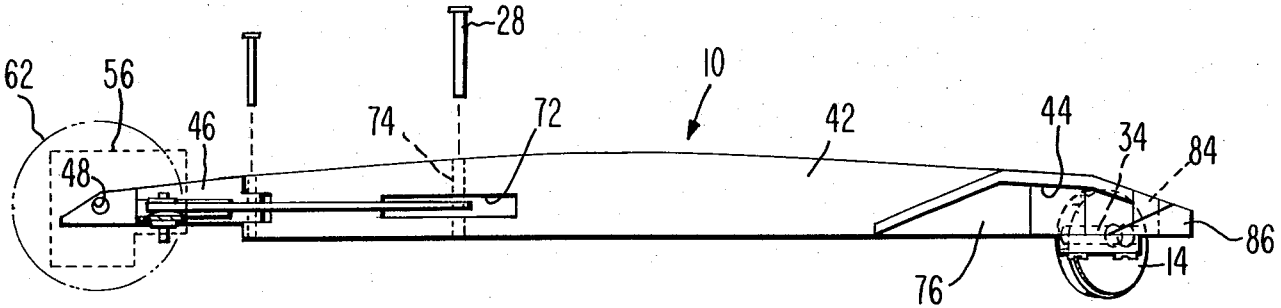
FIG. 6 is a side elevation view of the apparatus of FIG. 5 as viewed from the rear or back.
Figure 7:
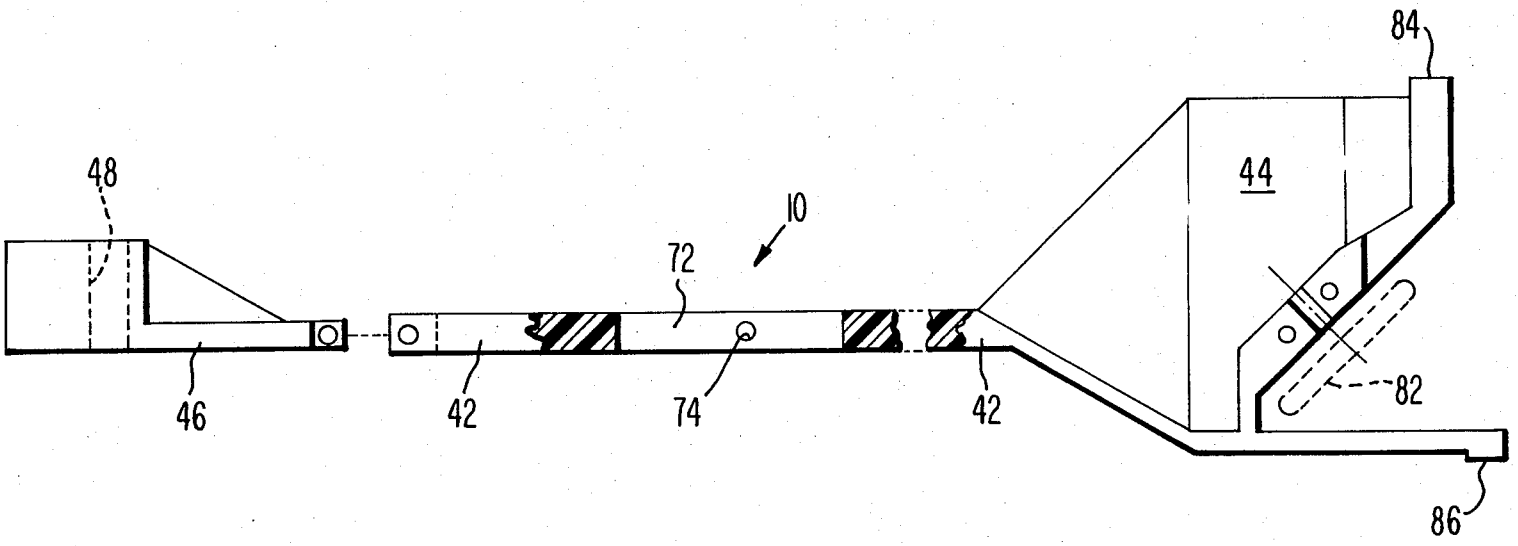
FIG. 7 is a top plan view of the apparatus of FIG. 6.

FIGS. 5, 6 and 7 illustrate in multiple views a physical embodiment of the invention described in conjunction with the highly schematic views of FIGS. 1–4 inclusive. Similar reference characters have been used where practicable while additional reference characters have been employed to illustrate additional details of construction and/or operation not previously described with respect to FIGS. 1–4 inclusive.

In connection with FIGS. 5, 6 and 7 (which are not drawn to precise or exact scale) it is seen that the member 10, the elongaged, articulated arm is illustrated in multiple parts due to drawing space limitations.

Referring first to the top plan view of FIG. 5, it can be seen that member 10 comprises a fairly long, relatively thin, rigid structure which is divided into two unequal length portions, i.e. a forwardly extending portion 42 having an irregularly shaped spatula or spade like end 44 and a rearwardly extending portion 46. Intermediate the two end portions and closer to the rearward attachment end is located the pivot hinge 32 earlier described. Rearward portion 46 is roughly triangular in outline shape and is provided with a cylindrical opening 48 through which extends a cylindrical busing 50 (FIG. 5).

Eccentric drive 12 is seen to comprise a crank shaft 52, the inboard end 54 of which extends through machine wall 56 via bushing 58 and carries a spacer 60 and a drive pulley 62. The latter being driven from the main machine drive through belt 64 only a portion of which is illustrated. The outboard end of crank shaft 52 extends into and through bushing 50 in cylindrical opening 48 for driving interconnection to arm 10, as will become clear hereinafter.

Cross arm or link 22, earlier referred to in connection with FIGS. 1–4 inclusive, comprises a relatively light weight, thin, rigid, elongate member, the leftward end 66 of which is pivoted to the fixed tang 68 projecting outwardly from the machine wall 56 by means of the pivot pin 24. The opposite rightward end 70 of link 22 extends into and through a horizontal disposed axial slot 72 (FIG. 6) in arm 10 and carries an elongated slot 26 which is adapted to slidingly engage and be retained by the pin 28. Pin 28 is fixed through arm portion 42 by means of a deformable shock absorbing member 74.

The rightward distal end 42 (spade shaped as at 44) is provided with an upstanding wall portion 78. Centrally located at about a 45 degree angle along notch 78 is an angled shaft support 80 to which is rotatably mounted a one way bearing or clutch 34 and a rubber tired wheel 82.

The inboard end of the spade shaped portion 44 is formed into a projection 84 so as to provide a bumper for machine member 10 as it moves the sheet item 16 against inner side wall 38 of the hopper 18. The outboard end of portion 44 likewise is formed to provide a bumper member 86, the latter acting to restrain the forward movement of arm 10 against an inboard wall projection (not shown) part of a paper handling recess in hopper 18, also not shown.

This structural arrangement utilizes only two walls for stacking sheet items and does away with the requirement for a door or removable wall member in order to empty a full stack. In the present invention the apparatus is "front" loaded and the stacked items are "front" removed or downloaded.

Also, since the bumper/deflectors overlap the wall this prevents item curl up. Since the arm 10 is driven from a continually running input belt driven from the main machine drive the arm is in constant motion during machine operation. Thus, so long as sheet items are being fed from chute 20 into hopper 18 the articulated movement of arm 10 will edge align the sheet item 16 in a neat edge aligned stack.

The arm goes through several cycles of motion between sheet entries into the bin 18. Hence each sheet item receives several "pushes" into the bin and against the end wall 36 and several "pushes" against the side wall 38. The arm can be driven by a timing drive such that it goes through an exactly integral number of cycles per sheet. This can be synchronized with sheet motion such that wheel 82 is at position 3 in FIG. 4 when this sheet hits wheel 82. This minimizes sheet skew in the hopper or bin 19 and reduces the distance the arm actually has to "push" the sheet item.

With the arm designed to rotate an integral number of revolutions per sheet stacked, a phase adjustment can be made to assure that the arm and roller/wheel are completely forward when the sheet finally contacts the roller. This reduces the possibility of a sheet bouncing off the roller/wheel and remaining out of reach of the stacking action of the apparatus.

What is claimed is:

1. Sheet item stacking apparatus comprising;

elongated, articulated means capable of moving both side to side and forwardly and rearwardly relative to an item receiving hopper;

means coupled to said articulated means providing forward and rearward movement thereof, rotatable means disposed on the free end of said articulated means and including means providing one way rotation of this latter means, means coupled to said articulated means for translating said forward and rearward movement into side to side movement effective to drive a sheet item forwardly into said item receiving hopper and sideways therein so as to edge align said item with other like items previously forwarded to said hopper.

2. The invention in accordance with claim 1 wherein said articulated means comprises a rigid, light weight, rod-like member having means permitting a portion of said member to be deflected sideways without fracture or breakage.

3. The invention in accordance with claim 1 wherein said articulated means comprises two individual segments hinged together so that one segment can move with respect to the other segment.

4. The invention in accordance with claim 1 wherein said means providing forward and rearward movement of said articulated means comprise an eccentric member driven by an external drive means.

5. The invention in accordance with claim 1 wherein said means providing one way rotation of said rotatable means comprises a one way clutch bearing.

6. The invention in accordance with claim 1 wherein said means for translating the forward movement into sidewise movement comprises a rigid link pivoted at one end to a fixed pivot point and pivotally coupled to said segmented means at the opposite end effective to produce sidewise movement of said articulated means.

7. The invention in accordance with claim 3 wherein one of said two segments carries a friction tired wheel and wherein said wheel is angularly mounted to said segment relative to the long dimension of said segment.

8. The invention in accordance with claim 1 wherein said articulated means comprises an elongated plastic member provided with oppositely disposed undercut sections forming a flexure so as to permit one end of said articulated means to bend relative to the long axis of said member.

9. The invention in accordance with claim 1 wherein one end of said articulated means is substantially spade shaped and relatively flat and includes oppositely disposed integral projecting portions effective to reduce the shock on said articulated means as it moves from side to side within said hopper.

10. The invention in accordance with claim 1 wherein said articulated means includes an elongated horizontal slot and wherein said translating means comprises a flat strip like member, one end of which is slotted and received within the horizontal slot of said articulate means and wherein the opposite end of said strip like member is mounted for vertical as well as horizontal movement at the fixed pivot point.

* * * * *